313-414 SR
10/27/87 OR 4,703,223

United States Patent [19]
Iguchi et al.

[11] Patent Number: 4,703,223
[45] Date of Patent: Oct. 27, 1987

[54] ELECTRON GUN FOR A COLOR DISPLAY APPARATUS

[75] Inventors: Yukinobu Iguchi; Kanemitsu Murakami; Masahiro Kikuchi, all of Tokyo, Japan

[73] Assignee: Sony Corporation, Tokyo, Japan

[21] Appl. No.: 802,476

[22] Filed: Nov. 27, 1985

[30] Foreign Application Priority Data

Nov. 28, 1984 [JP] Japan ..... 59-250764

[51] Int. Cl.[4] ..... H01J 29/62; H01J 29/50
[52] U.S. Cl. ..... 313/414; 313/412
[58] Field of Search ..... 313/414, 413, 412

[56] References Cited

U.S. PATENT DOCUMENTS 3,619,686 11/1971 Miyaoka ..... 313/412
3,651,359 3/1972 Miyaoka ..... 313/412

*Primary Examiner*—Palmer C. DeMeo
*Attorney, Agent, or Firm*—Hill, Van Santen, Steadman & Simpson

[57] ABSTRACT

An improved electron gun beam for a three color gun which has a central cathode and side cathodes mounted on either side of the central cathode which produce beams for different colors which pass through first and second grids and a main electron lens and wherein the first and second grids are generally conically shaped so that they extend toward the central cathode and have further indentations in their central portion which extend toward the central cathode and wherein the thickness of the second grid at the center wherein the beam of the central cathode passes therethrough is less than at the portions of the second grid where the beams from the two side cathodes pass therethrough and also where the distance between the central cathode and the indented portion of the first grid is larger than the distance between the two side cathodes and the distance to the first grid and/or the distance between the second and first grids is larger at the portion where the central cathode beam passes therethrough than where the beams of the two side cathdoes pass therethrough so as to provide optimum focusing voltage values and the voltage difference for optimum focusing for the respective beams is constand over the entire cathode current operating ranges.

3 Claims, 11 Drawing Figures

ELECTRON GUN FOR A COLOR DISPLAY APPARATUS

BACKGROUND OF THE INVENTION

1. Field of the Invention

This invention relates in general to an electron gun unit which has three cathodes for a color cathode ray tube wherein electron beams emitted from plural cathodes are focusesd by a single main lens and in particular it relates to an in line plural type single electron gun unit with the cathodes arranged on a straight line.

2. Description of the Prior Art

A prior art unipotential type three beam single electron gun is illustrated in FIG. 2 and comprises coaxially and sequentially arranged first to fifth grids G1 to G5 and three cathodes $K_R$, $K_G$ and $K_B$ which are horizontally arranged and are spaced equal distance from the first grid G1 such that their cathode surfaces are parallel to each other. The first and second grids G1 and G2 are formed so as to be cup-shaped and are provided with apertures or through-holes $h_1R$, $h_1G$, $h_1B$, $h_2R$, $h_2G$, $h_2B$ through which the beams pass. The third to fifth grids G3-G5 are generally tubular shaped.

A fixed voltage in the range of zero volts on a particular range is applied to the first grid G1 and a fixed voltage of approximately 0 to 1000 volts is applied to the second grid G2. A fixed voltage of about 20 to 30 K volts is applied across each of the third and fifth grids G3 and G5 and a fixed voltage in the range of 0 to 1000 volts is applied across the fourth grid G4. A subordinate electron lens Ls is formed primarily between the second grid G2 and the third grid G3 and a main electron lens $L_M$ is formed primarily between the third, fourth and fifth grids $G_3$, $G_4$ to $G_5$. The electron beams $B_R$, $B_G$ and $B_B$ respectively emanating from the cathodes $K_R$, $K_G$ and $K_B$ pass through the through-holes $h_1R$, $h_1G$, $h_1B$, $h_2R$, $h_2G$, $h_2B$ of the first and second grids G1 and G2 into the first stage lens or subordinate lens $L_S$ and are prefocused and caused to intersect at the center of the main electron lens $L_M$. The beams diverge from this point of intersection.

A convergent means C is mounted in the path of the electron beams $B_R$, $B_G$ and $B_B$ which have diverged from the center of the main lens $L_m$. The convergent means C is comprised of innerdeflection electrode plates $P_A$, $P_B$ which cause only the center beam $B_G$ of the three beams to pass therethrough and outer electrode plates $Q_A$, $Q_B$ arranged on the outer portions of the inner deflection electron plates and parallel thereto are utilized for converging and deflecting the beams $B_B$ and $B_R$. The voltage applied across the outer electrode plates $Q_A$ and $Q_B$ are set so as to be lower by 500 to 2000 volts than the voltage applied across the inner electrode plates $P_A$ and $P_B$, that is, the anode voltage such that the beam $B_B$ which passes through the opening between the electrode plates $P_A$ and $Q_A$ and the beam $B_R$ which passes between the electrode plates $P_B$ and $Q_B$ are deflected and converged on the center beam $B_B$ at different ones of a number of vertically extending strips or slits of a grid AG such as a shadow mask which is arranged adjacent a phosphor screen S. Similarly to a chromatron type phosphor screen, the phosphor screen S has a set of sequentially arranged red, green and blue phosphor stripes. The shadow mask grid AG causes the respective electron beams to land on associated phosphor lines of the phosphor surface S to produce a display. FIG. 2 illustrates a horizontal and vertical deflection device D arranged at the downstream side of the convergent means C between the convergent means and the screen S so as to control and deflect the beams.

With three beam single gun electron units such as described, the cathodes $K_R$, $K_G$ and $K_B$ are arranged such that the electron emitting surfaces of the cathodes lie in the same plane as illustrated. In this arrangement, the electron beam $B_G$ emanating from the central cathode $K_G$ and the electron beams $B_R$ and $B_B$ emanating from the two cathodes $K_R$ and $K_B$ mounted on the side of the center cathode $K_G$ the side beams $B_R$ and $B_B$ are subject to different optimum focusing conditions from each other relative to the focusing potential of the fourth or focusing electrode G4 pass through the subordinate electron lens Ls at its end such that they are offset from its optical axis and then through the center of the main electron lens Lm at a preset angle with respect to the center optical axis of the electron lens system such that the side beams $B_R$ and $B_B$ are subject to a converging action which is stronger than that of the center beam $B_G$ which passes through the center optical axis of the lens system. Thus, because of the field or image surface curvature aberration an error $\Delta z$ occurs between the image forming positions center beam $B_G$ and the side beams $B_R$ and $B_B$. This error is proportional to the square of the angle of intersection $\alpha$ of the side beams $B_R$ and $B_B$ with the center axis of the main electron lens $L_m$.

FIG. 3 is an equivalent optical model which shows that when the optimum focusing occurs for the side beams $B_R$ and $B_B$, the center beam $B_G$ will be in the underfocused state as illustrated in FIG. 3A. On the other hand, when the optimum focusing occurs for the central beam $B_G$, the two side beams $B_R$ and $B_B$ will be in the overfocused states as illustrated in FIG. 3B. Thus, the image forming surface of the central beam $B_G$ and those of the side beams $B_R$ and $B_B$ can be caused to coincide by decreasing or weakening the strength of the lens for the two side beams. Thus, a constant difference may be provided between the optimum focusing voltage Vf1 for the side beams $B_R$ and $B_B$ and the optimum focusing voltage $Vf_2$ for the central beam $B_G$ which is shown in the graph of FIG. 4 wherein the focusing voltage is plotted against the cathode current Ik. The voltage difference V between the optimum focusing voltage Vf1 for the side beams $B_R$ and $B_B$ and the optimum focusing voltage Vf2 for the central beam $B_G$ may differ depending upon the angle of intersection $\alpha$ of the side beams $B_R$ and $B_B$ with the central axis and upon the structure of the main lens Lm. However, in an electron gun used in a common type color TV receiver, the voltage difference may be of the order of 300–400 volts. In the electron gun of the type described above, the conventional practice is to apply a focusing voltage across the fourth grid G4 so that it is intermediate between the optimum focusing voltage for the central beam $B_G$ and that for the side beams $B_R$ and $B_B$ so that the central beam $B_G$ will be in a slightly underfocused state and the side beams $B_R$ and $B_B$ will be in a slightly overfocused state. This results in that optimum focusing is not simultaneously achieved with the three beams $B_R$ and $B_G$ and $B_B$ and the resolution is thus lowered.

So as to avoid such disadvantages, another type of electron gun is known and employed in which an object point P which is the cross-over point of the center beam $B_G$ is shifted toward the rear relative to the main electron lens for subjecting the center beam $B_G$ to a more intensive focusing action in a manner such that the three beams undergo an optimum focusing simultaneously.

FIG. 5 illustrates an equivalent optical model of the known system. In FIG. 5, the cross-over points in the first grid G1 and the second grid G2 of the electron gun represent the object point P corresponding to the object of the image spot in the optical lens system. Therefore, if according to the formula $$\frac{1}{\Delta A + A} + \frac{1}{B - \Delta B} = \frac{1}{f}$$

where f represents a focal distance of the main electron lens, A the distance between the central lens plane O of the main electron lens $L_m$ and the beam cross-over point A1 and B the distance between the central lens plane O of the main electron lens Lm and the optimum focusing position $B_1$ of the central beam $B_G$ when the cross-over point is at $A_1$, the object point or cross-over point P of the central beam $B_G$ is shifted to a point $A_2$ offset by $\Delta A$ from the point $A_1$, focusing of the central beam $B_G$ is optimized at a position $B_2$ shifted by a $\Delta B$ toward the main electron lens $L_m$ from the focusing position $B_1$.

In this manner, the side beams $B_R$ and $B_B$ are subjected to a more intense convergence than the central beam $B_R$ due to the shifting of the point of passage of the side beams $B_R$ and $B_B$ through the electron lens system. Thus, by suitably selecting the parameter $\Delta A$ in the above formula, the optimum focusing position and, thus, the optimum focusing voltage of the side beams $B_R$ and $B_B$ and of the central beam $B_G$, the beams can be caused to coincide with each other.

Since the main lens $L_m$ has spherical aberration, the image forming positions are changed with variable magnitudes of the divergent angles of the respective beams $B_R$ and $B_B$ although the object point P remains constant. Thus, for the constant parameters A and B, the larger that the angle of divergent becomes, the larger the focal distance f of the main electron lens Lm becomes and hence the optimum focusing voltage VF becomes higher.

So as to utilize this principle, the side portions of an end face 11 of the first grid G1 adjacent the side cathodes $K_R$ and $K_B$ and including the through-holes $h_1R$, and hhd 1B are formed as inclined surfaces 11*a* and 11*b* which incline toward the main lens Lm whereas the central portion 11*c* of the end face 11 facing the central cathode $K_G$ and including the through-hole $h_1G$ bulges in the opposite direction or in the inner direction. In a complementary manner, the side portions of the end face 12 of the cup-shape second grid G2 are formed as inclined surfaces 12*a* and 12*b* that are inclined similarly to the inclined surfaces 11*a* and 11*b* of the first grid G1 and the central portion 12*c* including the central through-hole $h_2G$ bulges in the direction of the first grid G1. The cathodes $K_R$, $K_G$ and $K_B$ are arranged in the first grid G1 in a manner such that the center cathode $K_G$ is mounted back of the side cathodes $K_R$ and $K_B$ with respect to the main lens Lm.

In an alternative arrangement illustrated in FIG. 7, not only are the side portions of the first and second grids G1 and G2 formed as inclined surfaces 11*a*, 11*b*, 12*a* and 12*b* but the central portion 12*c* of the end face of the second grid G2 including the through-hole $h_2G$ projects in a stepped manner of preset height as illustrated. In a complementary manner, central portion 11*c* of the end face 11 of the first grid G1 facing the step portion of the central portion 12 is recessed towards the inner side and formed as a step with corresponding height and the cathodes $K_R$, $K_G$ and $K_B$ which are mounted in the first grid G1 are arranged so that the central cathode $K_G$ is mounted in back of the side cathodes $K_R$ and $K_B$ relative to the main electron beam lens Lm.

In the above described arrangements, an improvement in the optimum focusing voltage difference $\Delta$ Vf between the central beam $B_G$ and the side beams $B_R$ and $B_B$ occurs with some degree of coincidence of the optimum focusing positions of the three beams. However, with a color cathode ray tube that can be used over a current range for small to large currents and which is adapted as a so-called character display system for a computer terminal device, the values of the optimum focusing voltage tend to cause the beams to become dispersed especially at the larger range of the cathode current Ik. Also, non-uniform focusing voltage tends to become more pronounced at the image periphery regions where deflection arrows also exist so that red and blue color bleeding is noticed around white characters.

Thus, with the arrangement illustrated in FIGS. 6 and 7 limitations are placed on the width of the central portions 11*c* and 12*c* which are recessed or projected from the side portions or inclined surfaces 11*a*, 11*b*, 12*a* and 12*b* with result that the lens action occurs at the outlets of the beams $B_G$, $B_R$ and $B_B$ from the second grid by voltage intrusion from the third grid G3 so that the divergent angles $\theta$ of the side beams $B_R$ and $B_B$ decrease thus lowering the optimum focusing voltage of the central beam $B_G$ in the higher range of the cathode current Ik.

FIG. 8 shows the relationship between the cathode current Ik and the optimum focusing voltage Vf1 for the side beams $B_R$ and $B_B$ as well as the optimum focusing voltage Vf2 for the central beam $B_G$ for the unit shown in FIG. 7. It can be observed from the diagram of FIG. 8 that the optimum focusing voltage Vf2 for the central beam $B_G$ increases for the lower range of the cathode current Ik so as to approach the optimum focusing voltage Vf1 for the side beams $B_R$ and $B_B$ when the object point or cross-over point P of the central beam $B_G$ shifts away from the main electron beam Lm. For larger currents the divergent angle $\theta$ of the side beams $B_R$ and $B_B$ is lowered with the result that the optimum focusing voltage Vf2 is lowered which enlarges the voltage difference $\Delta$ Vf from the optimum focusing voltage Vf1 of the side beams $B_R$ and $B_B$.

SUMMARY OF THE INVENTION

It is an object of the present invention to provide an electron gun for a color cathode ray tube wherein the voltage difference $\Delta$ Vf between the optimum focusing voltage Vf1 for the side beams $B_R$ and $B_B$ the optimum focusing voltage Vf2 for the central beam $B_G$ is maintained constant and is as small as possible for the overall range of the cathode current Ik in a manner such that the spot size of the respective beams $B_R$, $B_G$ and $B_B$ is kept uniform for both the lower and the higher range of the cathode current Ik so as to provide a clear color image which is free of color blooming.

So as to obtain the above object, the present invention comprises an electron gun unit which has a central cathode which emits an electron beam so that the beam falls on a main electron lens and which is mounted substantially at right angles to the electron lens and is mounted behind both of the side cathodes which emits side electron beams so that the beams will obliquely fall on the main electron lens and wherein the first and second grids are formed with depressions or recesses at the portions facing the central electrode and wherein the thickness of the plate in the recessed portion of the second grid is selected so as to be less than the thickness at either side of the second grid where the side beams pass therethrough and/or the distance between the central cathode and the recessed portion of the first grid is selected to be larger than that between the side cathodes and the portions of the first grid through which the beams from the side cathode pass, and/or the distance between the second and first grids is selected to be larger adjacent the central cathode than at the portions adjacent the two side cathodes in a manner such that optimum focusing voltage values for the respective beams are substantially matched over the overall current range.

Other objects, features and advantages of the invention will be readily apparent from the following description of certain preferred embodiments thereof taken in conjunction with the accompanying drawings, although variations and modifications may be effected without departing from the spirit and scope of the novel concepts of the disclosure and in which:

DESCRIPTION OF THE PREFERRED EMBODIMENTS

The electron gun according to the present invention is explained relative to the accompanying drawings and the components which are the same as those of the previously described prior art electron guns are depicted by the same numerals and the corresponding description is ommitted for simplicity.

Figure 1:
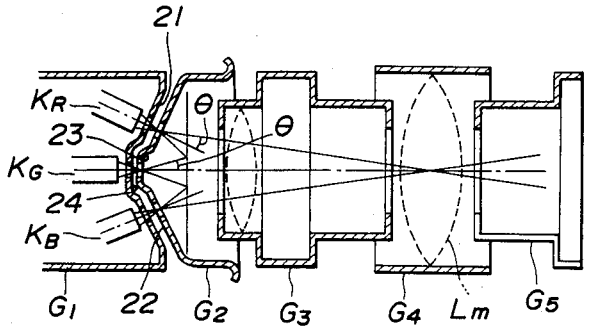
FIG. 1 is a sectional view showing essential parts of an exemplary electron gun unit according to the present invention.
Figure 2:
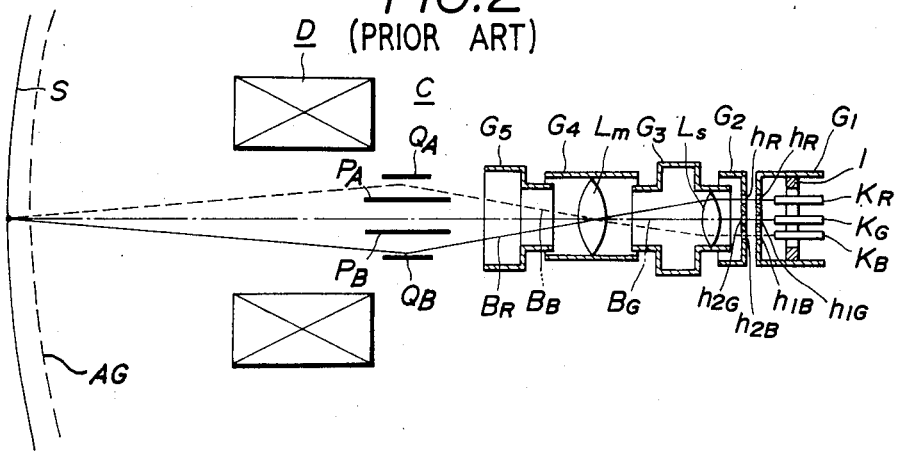
FIG. 2 (PRIOR ART)
FIG. 2 is a diagrammatic view showing a prior art electron gun unit.
Figure 3:
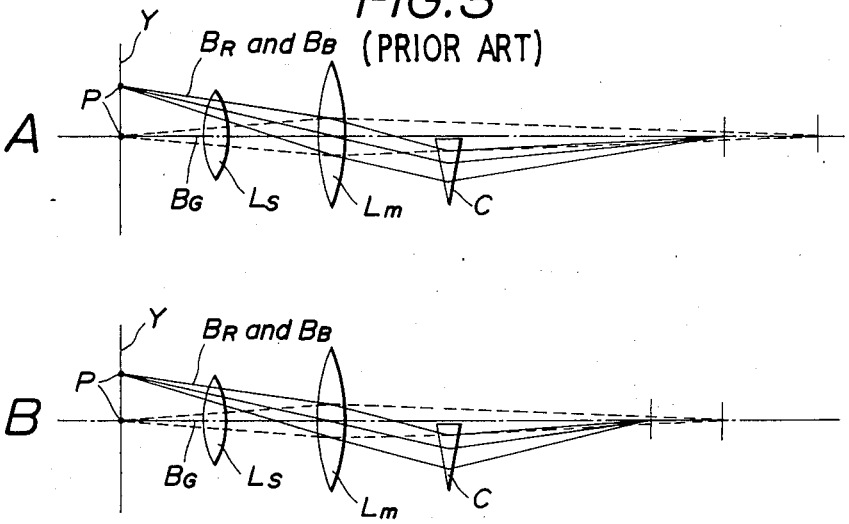
FIG. 3 (PRIOR ART)
FIGS. 3A and 3B illustrate equivalent optical models for the unit shown in FIG. 2.
Figure 4:
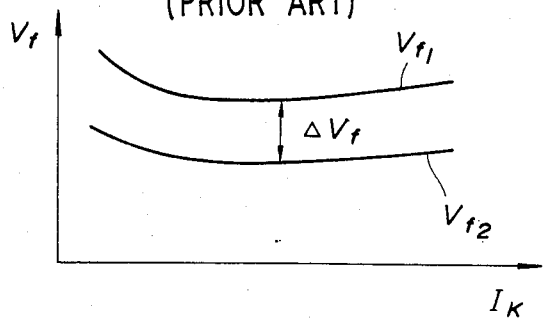
FIG. 4 (PRIOR ART)
FIG. 4 is a graph illustrating the relationship between the cathode current and the optimum focusing current for the central and side beams.
Figure 5:
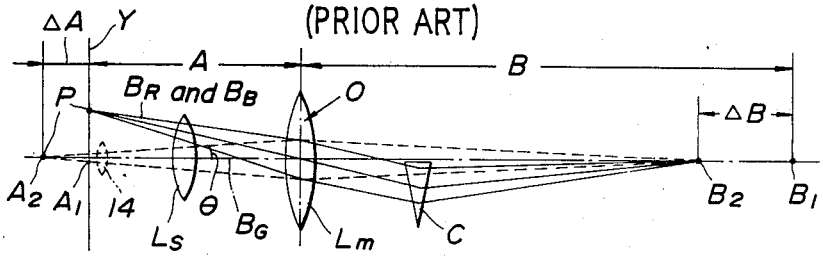
FIG. 5 (PRIOR ART)
FIG. 5 illustrates an equivalent optical model for another prior art electron gun unit and illustrates the principle of the gun unit.
Figure 9:
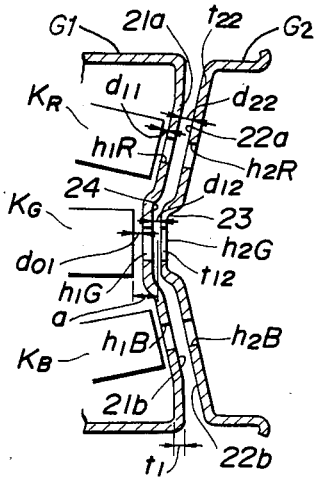
FIG. 9 is an enlarged view showing the relationship between the first and second grids of the electron gun unit of the present invention.

FIG. 1 illustrates the electron gun of the invention and FIG. 9 is an enlarged detail view of the first and second grids G1 and G2. The electron gun of the invention is illustrated with the side portions of the end face 21 of the first grid G1 which are adjacent to the side cathodes $K_R$ and $K_B$ which includes the apertures or through-holes $h_1R$ and $h_1B$ are formed as inclined surfaces 21*a* and 21*b* which incline toward the main lens Lm. In other words, the inclined surfaces 21*a* is inclined toward the upper right of FIGS. 1 and 2 and the inclined surface 21*b* is inclined to the lower right relative to FIG. 9. The side portions of the end face 22 of the cup-shaped second grid G2 are inclined surfaces 22*a* and 22*b* and are inclined so as to be parallel respectively to the inclined surfaces 21*a* and 21*b* of the grid G1. The through-holes $h_1R$ and $h_2R$ are aligned as are the holes $h_1B$ and $h_2B$ as shown in FIG. 9. The central portion of the end face 22 of the second grid G2 which carries the through-hole $h_2G$ is formed as a depression which extends toward the cathode $K_G$ and the central portion of the end face 21 of the first grid which is adjacent the depression 23 is depressed to form a portion 24 which extends in the direction of the central cathode $K_G$. The cathodes $K_R$ and $K_B$ are arranged within the first grid G1 so that they are perpendicular to the inclined surfaces 21*a* and 21*b* and the central cathode $K_G$ is mounted behind the extending portion 24 such that it is back of the side cathodes $K_R$ and $K_B$ and has a spacing from the main lens Lm which is larger than the spacing of the side cathodes from the main lens $L_m$.

Figure 6:
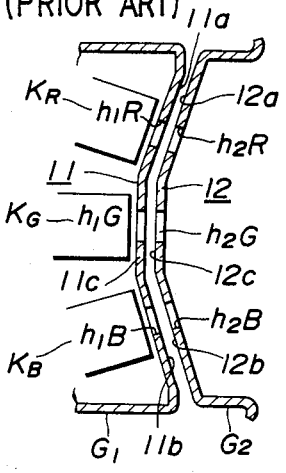
FIG. 6 (PRIOR ART)
FIG. 6 is a sectional view showing an example of a prior art electron gun unit.
Figure 7:
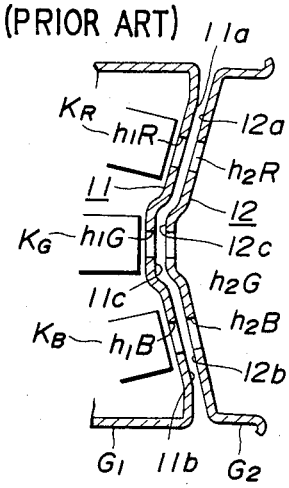
FIG. 7 (PRIOR ART)
FIG. 7 is a sectional view illustrating another prior art electron gun unit.

In the present embodiment the thickness $t_{12}$ of the extending portion 23 of the second grid G2 is selected so that it is less than the thickness $t_{22}$ of the side portions 22*a* and 22*b* which are adjacent the cathodes $K_R$ and $K_B$ as illustrated in FIG. 9. The distance $d_{01}$ between the center cathode $K_G$ and the depressed portion 23 of the first grid G1 is selected so that it is larger than the distance $d_{11}$ between the side cathodes $K_R$ and $K_B$ and the adjacent inclined surfaces of the first grid G1. Also, the distance $d_{12}$ between the second grid G2 and the first grid G1 in alignment with the central cathode $K_G$ is selected so that it is less than the distance $d_{22}$ between the grid G1 and G2 adjacent the side cathodes $K_R$ and $K_B$. It has been discovered that for the larger current range of the cathode current Ik the above-described arrangement of the first and second grids G1 and G2 with the plate thicknesses as described above for the extending portions 23 and 24 results in that the angles of divergence $\theta$ of the center beam $B_G$ and of the side beams $B_R$ and $B_B$ when compared with the structure of the conventional electron gun illustrated in FIG. 6 will be as shown in the following table 1.

TABLE 1

| | embossed portions $G_1$ and $G_2$ | small thickness $t_{12}$ of the embossed portion of $G_2$ | $d_{01}$ large | $d_{02}$ small |
|---|---|---|---|---|
| central beam $B_G$ | ↘ | ↗ | ↗ | ↗ |
| side beams $B_R$,$B_B$ | → | → | → | → |

In the Table, → designates that no change in the effect as compared to the conventional electron gun and arrows extending up and down indicate increasing and decreasing effect as compared with a conventional electron gun respectively.

Figure 8:
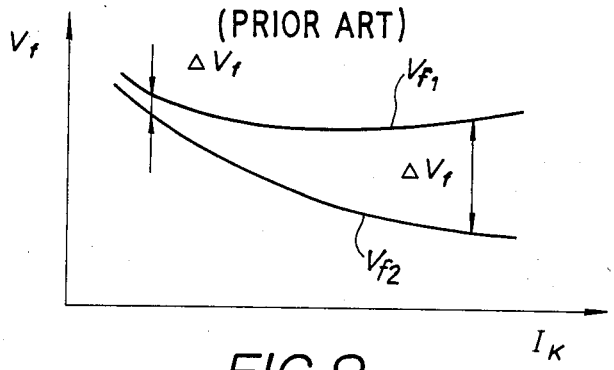
FIG.8 (PRIOR ART)
FIG. 8 is a graph showing the relationship between the cathode current and the optimum focusing voltage for the central and side beams for the gun unit shown in FIG. 7.
Figure 10:
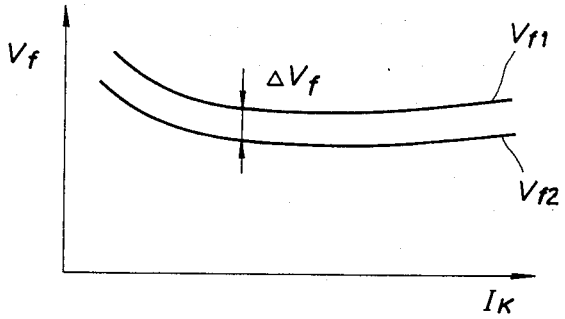
FIG. 10 is a graph showing the relationship between the cathode current and the optimum focusing voltage for the central and side beams for the unit shown in FIG. 9.

Table 1 illustrates that by setting the plate thickness $t_{12}$ of the extending portion 23 of the second grid G2 so that it is smaller than the plate thickness $t_{22}$ of the side portions and while setting the distance $d_{01}$ between the central cathode $K_G$ in the first grid G1 to be larger than the distance $d_{11}$ between either of the side cathodes $K_R$ and $K_B$ and the first grid G1 and also setting the distance between the second grid G2 and the first grid G1 to be smaller adjacent the central cathode $K_G$ then at the side cathodes $K_R$ and $K_B$ that the difference between the divergent angle $\theta$ for the center beam $B_G$ in that for the side beams $B_R$ and $B_B$ for the larger range of the cathode current $K_1$ resulting from the arrangement of the extending portions 23 and 24 of the first and second grids $G_1$ and $G_2$ which is shown in FIG. 8 may be eliminated. The result is that the advantage relative to the optimum focusing voltage difference Δ Vf between the central beam $B_G$ in the side beam $B_B$ for the low current range obtained by shifting the object point P of the center beam $B_G$ may also be achieved for larger current ranges. The resulting optimum focusing voltage is Vf1 and Vf2 for the side beams $B_R$ and $B_B$ and the central beam $B_G$ of the electron gun of the present invention shown in FIG. 1 are illustrated in FIG. 10. It is to be noted from FIG. 10 that the optimum focusing voltage difference Δ Vf is substantially constant and is smaller than that of the prior art devices which have been described above for the overall range of the cathode current Ik.

In a practical example, of apparatus built according to the present invention, the aperture diameters of the first and second grids G1 and G2 is equal to 0.65 mm and the voltage difference Δ Vf was 100–150 volts for the overall range of the cathode current Ik. In the test apparatus, the parameters were as follows: $d_{01}$ was 0.18 mm, $d_{11}$ was 0.14 mm, the plate thickness $t_1$ of the first grid G1 was 0.1 mm, the parameter $d_{12}$ was 0.29 mm, the parameter $d_{22}$ was 0.35 mm, the plate thickness $t_{12}$ was 0.12 mm, and the plate thickness $t_{22}$ was 0.2 mm.

The depth of the projection 24 of the first grid G1 was 0.24 mm and the depth of the projection 23 of the second grid was 0.3 mm.

In the structure of the invention the optimum focusing voltage difference Δ Vf can be made to be substantially constant over the entire range of the cathode current Ik so that the spot size of the respective beams $B_R$, $B_G$ and $B_B$ can be made constant for the overall current which results in a clear image display which is free of color blooming.

It should be noted that the difference in the diverging angles $\theta$ of the side beams $B_R$ and $B_B$ in the central beam $B_G$ for the larger range of the cathode current Ik caused by the extending portions 23 and 24 of the first and second grids G1 and G2 can be eliminated by selectively reducing the thickness of the plate of the extending portion of the second grid G2 in the center portion adjacent the cathode $K_G$ relative to the portions of the grid G2 which are adjacent the side cathodes $K_R$ and $K_B$ and/or reducing the distance between the second grid G2 and the first grid G1 adjacent the central cathode $K_G$ relative to the distance between the first and second grid adjacent the side cathodes. For this reason, the present invention is not limited to the above described illustrative embodiment. It will be appreciated that by reducing the thickness of the extending portion 23 of the second grid G2 as compared to the side portions adjacent the cathodes $K_R$ and $K_B$ and/or enlarging the distance between the central cathode $K_G$ and the first grid $G_1$ as compared to that between the side cathodes $K_R$ and $K_B$ and the first grid G1 and/or reducing the distance between the second grid G2 and the first grid G1 at the central cathode $K_G$ as compared to the distance between the first and second grids adjacent the side cathodes $K_R$ and $K_B$, the difference between the angle of divergence data of the central beam $B_G$ and that of the side beam $B_R$ and $B_B$ is eliminated and the effect of separating the object point P of the central beam $B_G$ away from the main lens $L_m$ is assured not only for the lower range but also for the higher range of the cathode current Ik and the voltage difference Δ Vf between the optimum focusing voltage $Vf_1$ for the side beams $B_R$ and $B_B$ and the optimum focusing voltage $Vf_2$ for the central beam $B_G$ can be kept constant and as low as possible over the overall range for the cathode current Ik in a manner such that the spot size of the beams $B_R$ and $B_G$ and the $B_B$ can be kept constant over the overall range for the cathode current Ik and a clear well-defined image display will result without color blooming. Thus, the present invention can be applied to devices over a very broad range of current intensity such as color cathode ray tubes providing for character display.

Although the invention has been described with respect to preferred embodiments, it is not to be so limited as changes and odifications can be made which are within the full intended scope of the invention as defined by the appended claims.

We claim as our invention:

1. An electron gun unit of the in-line type comprising first and second grids and a central cathode spaced from said first and second grids and which emits an electron beam so that the beam passes through a main electron lens substantially at right angles and is arranged with respect to said lens at the backside of a pair of side mounted cathodes which emit side electron beams so that the beams obliquely pass through said main electron lens, and wherein said first and second grids have central portions and side portions and are formed with depressions at the central portions thereof adjacent to said central cathode, characterized in that the plate thickness of the portion of said second grid in which said depression is formed is selected to be less than the thickness of said second grid at the side portions of said second grid, the distance between the central cathode and the depression of said first grid is larger than the distance between the side cathodes and the side portions of said first grid, the distance between the second and first grids is selected to be larger at the portion adjacent the central cathode than the distance between the first and second grid at the portions adjacent said side cathodes, so that the optimum focusing voltage values for the respective beams and the voltage difference between the optimum focusing voltage for the respective beams is constant for the overall cathode current range.

2. An electron gun unit of the in-line type comprising first and second grids and a central cathode spaced from said first and second grids and which emits an electron beam so that the beam passes through a main electron lens substantially at right angles and is arranged with respect to said lens at the backside of a pair of side mounted cathode which emit side electron beams so that the beams obliquely pass through said main electron lens, and wherein said first and second grids have central portions and side portions and are formed with depressions at the central portions thereof adjacent to said central cathode, characterized in that the plate thickness of the portion of said second grid in which said depression is formed is selected to be less than the thickness of said second grid at the side portions of said second grid, so that the optimum focusing voltage values for the respective beams and the voltage difference between the optimum focusing voltage for the respective beams is constant for the overall cathode current range.

3. An electron gun unit of the in-line type comprising first and second grids and a central cathode spaced from said first and second grids and which emits an electron beam so that the beam passes through a main electron lens substantially at right angles and is arranged with respect to said lens at the sideback of a pair of side mounted cathodes which emit side electron beams so that the beams obliquely pass through said main electron lens, and wherein said first and second grids have central portions and side portions and are formed with depressions at the portions thereof adjacent to said central cathode, characterized in that the plate thickness of the portion of said second grid in which said depression is formed is selected to be less than the thickness of said second grid at the side portions of said second grid, and the distance between the central cathode and the depression of said first grid is larger than the distance between said side cathodes and the side portions of said first grid, so that the optimum focusing voltage values for the respective beams and the voltage difference between the optimum focusing voltage for the respective beams is constant for the overall cathode current range.

* * * * *